US006176976B1

(12) United States Patent
Carter

(10) Patent No.: US 6,176,976 B1
(45) Date of Patent: Jan. 23, 2001

(54) PROFILE CONTROL WEIR FOR CYLINDER PAPER MACHINES

(76) Inventor: Eugene Currin Carter, 411 E. Richardson Cir., Hartsville, SC (US) 29550

( * ) Notice: Under 35 U.S.C. 154(b), the term of this patent shall be extended for 0 days.

(21) Appl. No.: 09/366,331

(22) Filed: Aug. 2, 1999

(51) Int. Cl.[7] ..... D21F 1/00

(52) U.S. Cl. ..... 162/338; 162/259; 162/323; 162/336; 162/314; 162/321; 162/327; 162/329; 162/337

(58) Field of Search ..... 162/338, 198, 162/343, 259, 314, 321, 323, 327, 329, 337, 336

(56) References Cited

U.S. PATENT DOCUMENTS

| | | |
|---|---|---|
| 1,771,600 | 7/1930 | Yoder . |
| 2,127,698 | 8/1938 | Miks . |
| 2,658,429 | 11/1953 | Malkin . |
| 3,035,636 | 5/1962 | Pescatello . |
| 3,772,144 | 11/1973 | Luthi et al. . |
| 4,085,003 | 4/1978 | Luthi . |
| 5,302,250 | 4/1994 | Peterson et al. . |
| 5,792,319 | 8/1998 | Bennett . |

*Primary Examiner*—Peter Chin
*Assistant Examiner*—Mark Halpern
(74) *Attorney, Agent, or Firm*—Dennison, Scheiner, Schultz & Wakeman

(57) ABSTRACT

A profile control weir for feeding dilute pulp suspension to a pond having a cylinder rotating therein which deposits pulp fibers onto a felt. The weir includes a head box having an inlet for pulp suspension disposed in a lower portion, optionally, a making board disposed along an upper front edge of the head box over which pulp suspension flows into the pond, at least three profile control boards disposed parallel to the upper front edge of the head box, each profile control board including at least one raised portion having a flat top portion, a flat lower portion, and connecting side portion.

10 Claims, 6 Drawing Sheets

FIG. 1
PRIOR ART
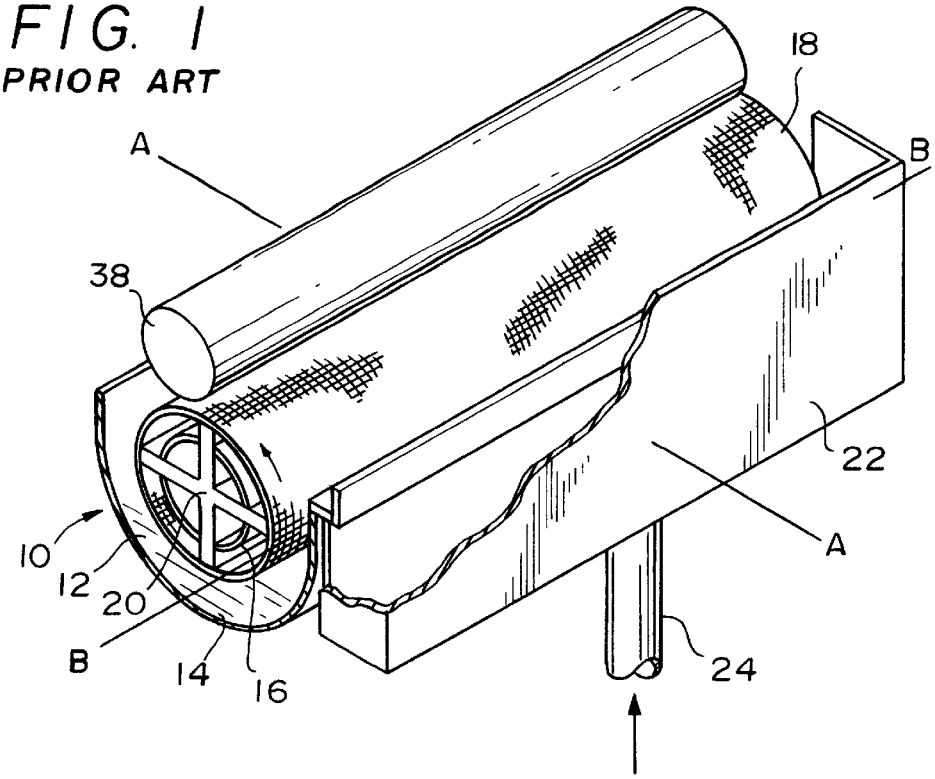
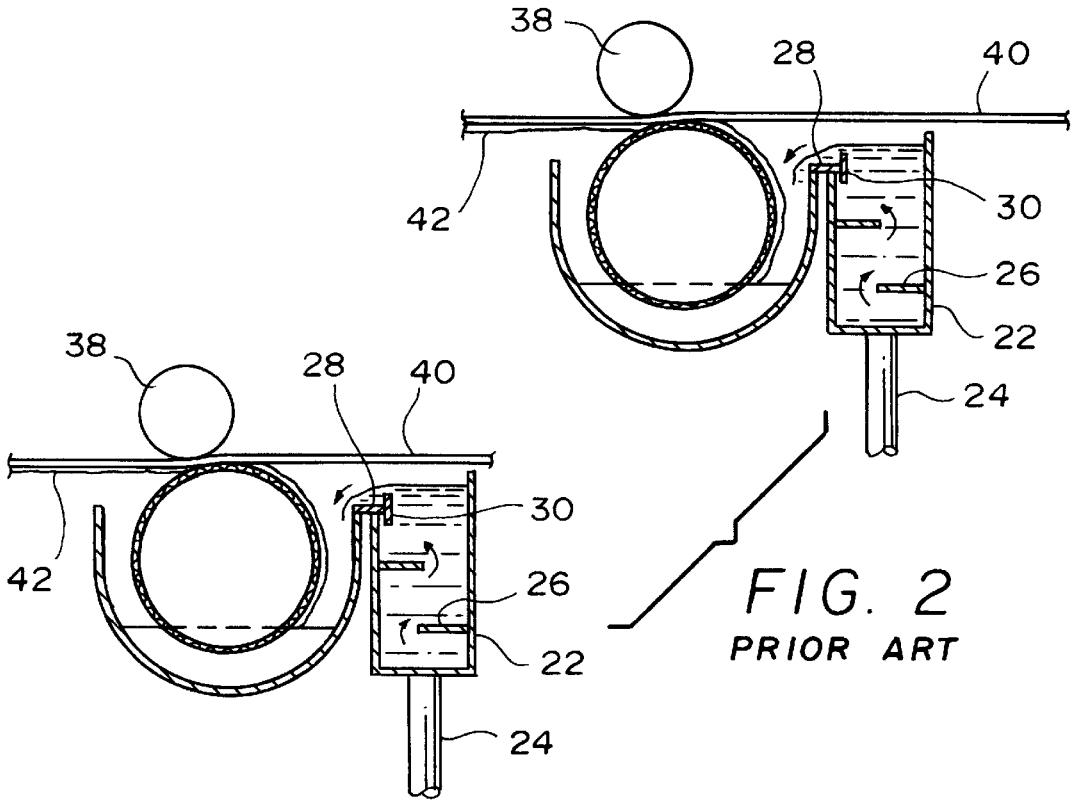
FIG. 2
PRIOR ART

BEFORE ADJUSTMENT

AFTER ADJUSTMENT

BEFORE ADJUSTMENT

AFTER ADJUSTMENT

BEFORE ADJUSTMENT

AFTER ADJUSTMENT

BEFORE ADJUSTMENT

AFTER ADJUSTMENT

PROFILE CONTROL WEIR FOR CYLINDER PAPER MACHINES

BACKGROUND OF THE INVENTION

The invention relates to a cylinder paper machine, and more particularly to means for controlling paper thickness across the width of the paper produced.

Paperboard is often made on cylinder paper machines, having at least one forming cylinder and often six, seven or more cylinders. A thin ply of paper is formed on each of the cylinders from a dilute suspension of paper fibers and water, and the wet, freshly formed plies are squeezed together before going to a wet pressing section which removes some of the water and more firmly bonds the plies together. The web, which then contains 40 to 60% moisture, goes to a dryer section where the sheet is dried to the desired moisture content.

Each cylinder of the paper machine is formed from a screen which is wrapped around a rigid frame to form a cylinder which is typically 36 to 48 inches in diameter and 50 to 150 inches in length. The screen rotates through a pond holding the suspension of paper fibers and water, with the end of the screen sealed by chime bands which prevent the pond from flowing around the ends of the cylinder. The pond is held by a vat, or in dry vat machines, by a portion of a vat with a seal strip to keep the stock suspension from leaking by the face of the cylindrical screen.

As the cylinder rotates, the pulp suspension is deposited on the wire mesh cylinder. The liquid of the suspension passes through the wire mesh and drains into the cylinder, while the wood pulp fibers remain upon the wire mesh. Near the top of the cylinder there is disposed a couch roll, and the fibers which have now been formed into a thin ply or mat are squeezed or "couched" off the screen to a moving endless blanket called a paper making felt. The ply is pulled away from the cylinder, and the cleaned cylinder portion rotates again into the pond to pick up fresh suspension. The felt moves on until it has picked up plies from all the cylinders operating on the paper machine, and then carries the wet web through the first press section or sections.

The basis weight of the paper board, as measured in grams per square meter, pounds per 1,000 square feet or other units, should be as uniform as possible for any given grade of paperboard. Control of basis weight can be stated in terms of machine direction control (length of the web) or cross machine direction control (width of the web).

Cross machine of basis weight is deter mined by several major factors:

1. Pond consistency: a uniform consistency (fiber to water ratio) of the fiber suspension in the cross direction of the pond is necessary for uniform cross machine pickup of the fibers onto the cylinder. If the consistency is not uniform, the cylinder will pick up more fibers where the fiber to water ratio is higher, and less fiber where the fiber to water ratio is lower. The drainage rate of the stock, as measured by a freeness test, also has an effect on the pick-up rate on the cylinder. However, the consistency across the vat pond and the freeness across the vat pond are closely related, so they will not be separately considered herein;

2. Fiber wash-off: any wash-off of fibers from the mat formed on the cylinder by impingement of inlet stock flow on the mat, either above or below the pond level, will result in uneven basis weight in the cross machine direction, unless the wash-off is uniform across the cylinder;

3. Dirty forming cylinder: any area of the cylinder that is not cleaned will pick up less fiber than the remainder of the cylinder;

4. Excessively high consistency: if the fiber to water ratio of the stock in the pond becomes too high, it will create non-uniform and unstable consistency in the pond. This is a separate problem from the pond consistency discussed above and results from overloading of stock in the pond.

A number of techniques are used by paper makers to adjust the vat pond consistency of the suspension in the cross machine direction, these techniques generally involving the use of a head box, sometimes called a vat inlet section, or weir just upstream of the part. Thus, wood pulp is mixed with water in a stock chest, and the suspension is pumped from the stock chest to the head box. The inlet of the head box is in the bottom portion. The head box normally contains a series of baffles designed to spread the flow uniformly across the width of the machine. The suspension overflows the head box over a making board into the pond.

Wing boards are commonly used to adjust the volumetric distribution of stock suspension flowing into the pond from the weir. A wing board is a barrier placed in the cross machine direction in the upper portion of the head box which includes a central pivot. The position of the wing board is fixed, but the pivot enables the ends of the board to be raised or lowered at the edges of the head box to change the slope of the surface over which the stock suspension flows. The resulting surface is in the shape of a "v", and the volume of the dilute stock suspension in the shallow sides is less than the volume in the deeper center portion. Since there is less dilute stock solution flowing into the edges of the vat pond, this increases the relative consistency at the ends of the pond, and increases the basis weight of the mat formed at those portions of the cylinder.

The use of wing boards is satisfactory to adjust the weight so that it is even on both sides of the machine, but is not satisfactory for finer adjustments across the machine.

The wing board can also be installed with its center raised above the making board, with the board pivoting into a "v"-shape or inverted "v"-shape. In the inverted "v"-shape, the wing board can be used to increase the weight of the center section of machine relative to the edges.

Compound wing boards are also known, compound wing boards including, in addition to a central pivot, pivoting portions at both ends. The pivoting end portions are upwardly movable only. Compound wing boards provide only a limited improvement in adjustment capability over wing boards.

Other techniques for controlling cross machine consistency include dams or restrictors located at the ends of the making board, or "irons" or restrictors placed where needed on the making board, to reduce the amount of inlet flow into the pond at those points, "tins" or extenders on the making board to carry the inlet flow closer to the cylinder, so it impinges on the mat over a particular cross machine section, thus washing some fibers off the mat, and injection of water into the pond or inlet to change the consistency of a specific cross machine section.

Another technique is the use of a sectional metering slots in the inlet flow all the way across the inlet to control the inlet flow by sections. This technique is a described in U.S. Pat. No. 5,792,319, which shows in FIG. 7 corresponding overflow plates at the top portion of the head box. The sectional metering is accomplished by means of a plurality of pivoting sections disposed in the cross machine direction. These pivoting sections can be remotely controlled, and provide good control but are more costly and complex than wing boards.

SUMMARY OF THE INVENTION

It is therefore an object of the invention to provide a more precise means for controlling consistency of stock in the cross machine direction in papermaking, without greatly increasing the cost or complexity of the machine.

To achieve this and other objects, the invention provides a profile control weir for cylinder paper machines having at least two sections disposed sequentially in the machine direction, with at least one of the sections pivoting in the cross machine direction, and typically, one section being fixed. The dilute inlet paper stock or other dilute fibrous material flows over the control weir before entering the pond or vat holding the forming cylinder. The volume of inlet stock flowing over each section may be individually adjusted relative to the other sections by adjusting the relative elevation of each of the sections.

Each section has an active portion in the form of a thin plate with a flat top. The sides of each section are preferably tapered in order to provide a smoother transition between sections, but this is not required. The center section of the control weir has a fixed elevation, while the other sections have an active portion which extends above the carrier portion. The carrier portion provides a movable platform for the active portion. The adjustable sections pivot from the center, or from a point offset from the center, and their ends extend to the edge of the vat inlet where an elevation adjustment device is attached. This adjustment device can be a simple mechanical device such as a screw, or it can be a more sophisticated control means such as an electric or pneumatic device to provide remote or automated control. The electric or pneumatic actuators would be connected to an extension of the movable wing boards that would rise above the end of the vat wall and reach out far enough so that the actuator could be attached.

For most applications, a total of five fixed or movable boards, usually four movable and one fixed, will be suitable; three boards will be acceptable on some machines, while other machines will require seven boards. More than seven boards will work, although such an arrangement may not be practical.

The actual design of the profile control boards for a particular machine will take into account the most likely sources of profile upsets and the lengths of the sections should be the proper lengths to correct such upsets. For example, in a 100 inch wide machine, a three-board system might be used, with the center fixed board 80 inches wide, and the edge boards 10 inches wide. If there are other sources of upset, a five board system might be used, with the edge boards 10 inches wide, but the center board only 40 inches wide; intermediate boards which are 20 inches wide would be provided. If the machine is very wide and has a poorly designed inlet section, seven boards might be used.

Cross machine basis weight profile is controlled by controlling the cross machine consistency in the pond, and also by controlling the amount of stock washed off the forming cylinder by the inlet stock. The consistency of the stock in the pond holding the forming cylinder is higher than the consistency of the inlet stock because of the thickening action of the forming cylinder on the stock. The amount of paper stock picked up on the forming cylinder is relative to the consistency of the stock in the pond. The control weir allows the selective dilution of cross machine sections of the pond to achieve the desired cross machine basis weight profile. While this is the same theory used in wing board control of the profile, a more precise control is provided across the entire width of the formed sheet.

The control weir of the invention is advantageous in that it provides both positive and negative basis weight control of individual sections across the width of the cylinder paper machine. Control is accomplished by controlling the dilution of stock in the pond from the front edge across the machine to the back edge. The control is more precise than possible with a two-piece wing board, or even with compound wing boards. It is also easier for machine tenders to comprehend than compound wing boards.

Control is accomplished by adjustments made at each edge of the machine where the control means is accessible to the machine tender, or where remote control devices can be easily attached without piercing in the vat inlet walls or obstructing the vat inlet in any way. When the active portion of each section has a flat top and tapered sides, the overlapping tapered sides provide a smooth transition between adjacent sections where adjustments are made.

Edge effects on a cylinder machine are generally the largest and most troublesome upsets to the basis weight profile. They are largest at the very edge and blend in rapidly so that the effect is relatively small, or not detectable near the center. This type of a upset gives a curved profile with the greatest change in profile at or near the edges. The length of the edge control section can be shortened, and the location of the pivot point can be offset toward the edge. This will accentuate the outermost portion of the correction, which in turn will provide a basis weight correction that closely matches the basis weight upset caused by the edge effect. This enables the machine tender to custom fit the profile correction to the need. Moreover, a control weir can be custom fit to provide excellent edge control with minimum effect on the remainder of the profile.

BRIEF DESCRIPTION OF THE DRAWINGS

FIG. 1 is a cut away plan view of a prior art cylinder paper machine;

FIG. 2 is a cross-sectional view of the apparatus shown in FIG. 1 along line A—A;

FIGS. 8(*b*)–11(*b*) are graphs of basis weight of papers in the cross-machine direction after correction according to the invention.

DESCRIPTION OF THE PREFERRED EMBODIMENTS

Figure 3:
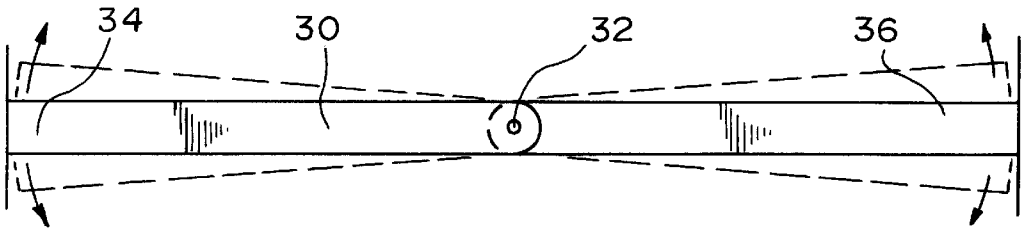
FIG. 3 PRIOR ART
FIG. 3 is a cross-sectional view of the apparatus shown in FIG. 1 along line B—B.

A typical prior art cylinder paper machine 10 is shown in FIGS. 1–3. Machine 10 includes a pond 12 containing a pulp suspension 14. Rotating in the pond is a cylinder 16 formed of an outer screen 18 on a frame 20.

Pulp suspension is added to the pond 12 from a head box 22 having an inlet 24 located in the lower portion the head box. Suspension flows upwardly around baffles 26 to the top of the head box where it flows over making board 28 into the pond. A wing board 30 is located in the upper portion of the head box; pivot 32 enables ends 34 and 36 to be separately raised or lowered.

A couch roll 38 is disposed just above the cylinder. A continuous papermaking felt 40 is pulled between the cylinder and the couch roll, with the cylinder depositing pulp fibers onto the papermaking felt. A corresponding apparatus located ply to be deposited onto the first ply on the papermaking felt. A plurality of plies maybe deposited in this manner.

Figure 4:
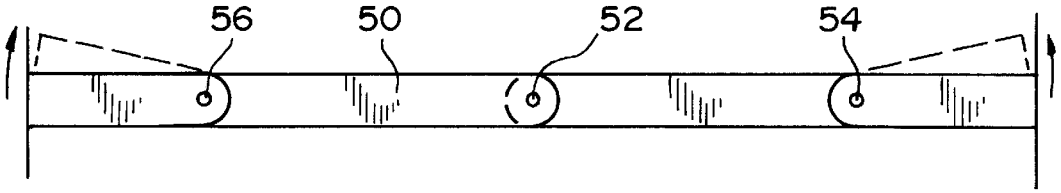
FIG. 4 PRIOR ART
FIG. 4 is a variation of the embodiment shown in FIG. 3.

A variation of the wing board is shown in FIG. 4. The wing board 50 of FIG. 4 includes a first pivot 52 in the center of board, a second pivot 54 located at one end of the board and a third pivot 56 located at the opposite end of the board. This arrangement enables more precise control of liquid level.

Figure 5:
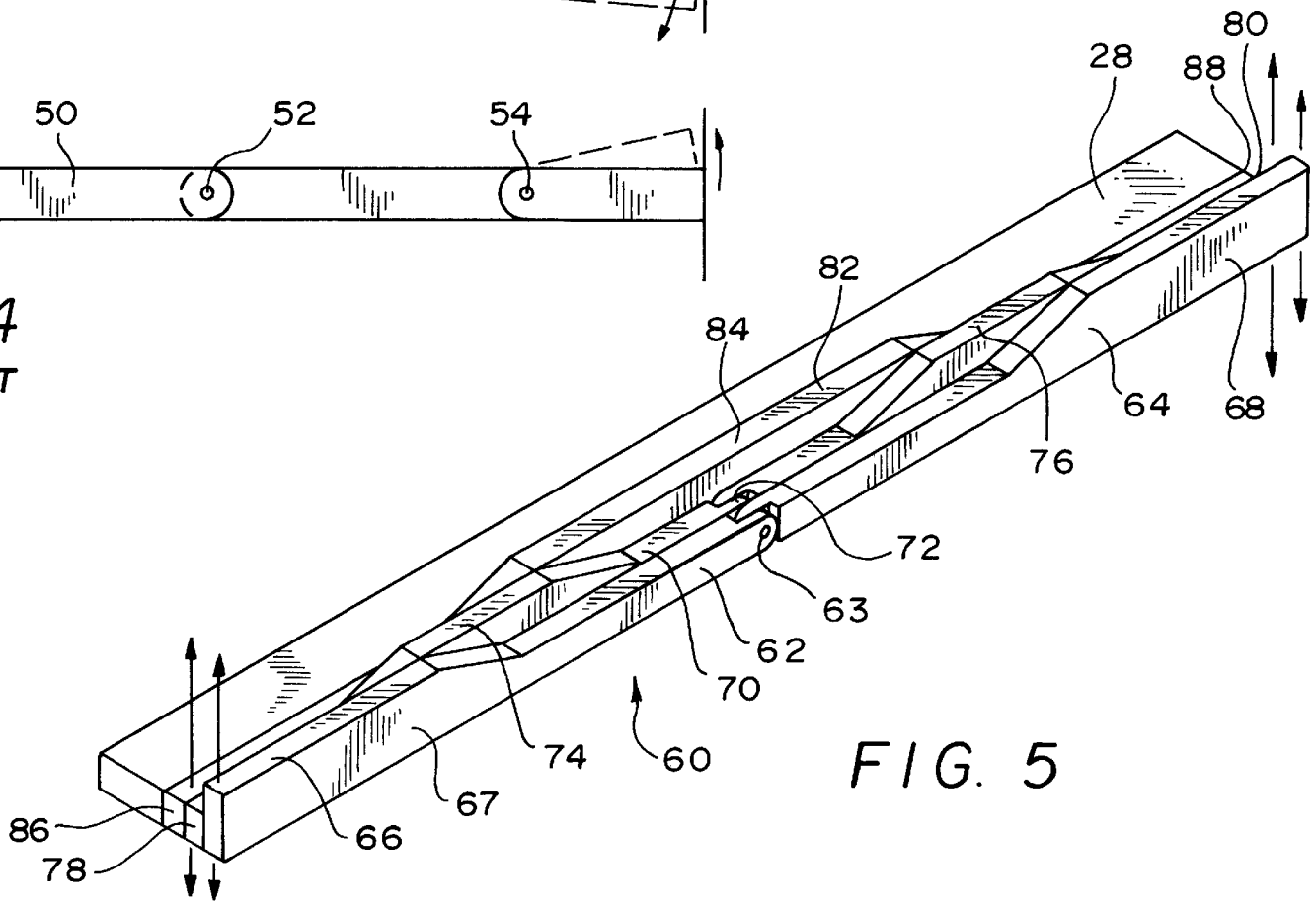
FIG. 5 is a perspective view of the profile control weir according to the invention.

According to the invention, the prior art wing board is replaced by the multi-section control device 60 shown in FIG. 5. The device shown in FIG. 5 has three sections and five control boards; optionally, additional control boards may be used.

Each of the control boards shown in FIG. 5 includes a raised portion with a flat top and tapered side. The first section 62 includes a center pivot 63 and board 64 with raised end 66 and board 67 with raised end 68. The center section 70 also includes a central pivot 72 with a board 73 with raised portion 74 and a board 75 with raised portion 76, respectively, disposed just to either side of central pivot 72. End portions of 78 and 80 are disposed at the height of the central portion.

The third section 82 is fixed in position, and includes a board 83 with a raised central portion 84 and lowered end portions 86 and 88. This board is generally mounted on the making board and centered between the front and the back edges of the pond inlet.

Raised portions 66 and 68 control flow over the front and back edges of the making board. They can be raised or lowered with reference to the fixed, center section and are usually the most important because most basis weight upsets are initiated at the edges of the machine.

Raised portions 74 and 76 control flow over the front center and back center sections of the making board.

Figures 6, 7:
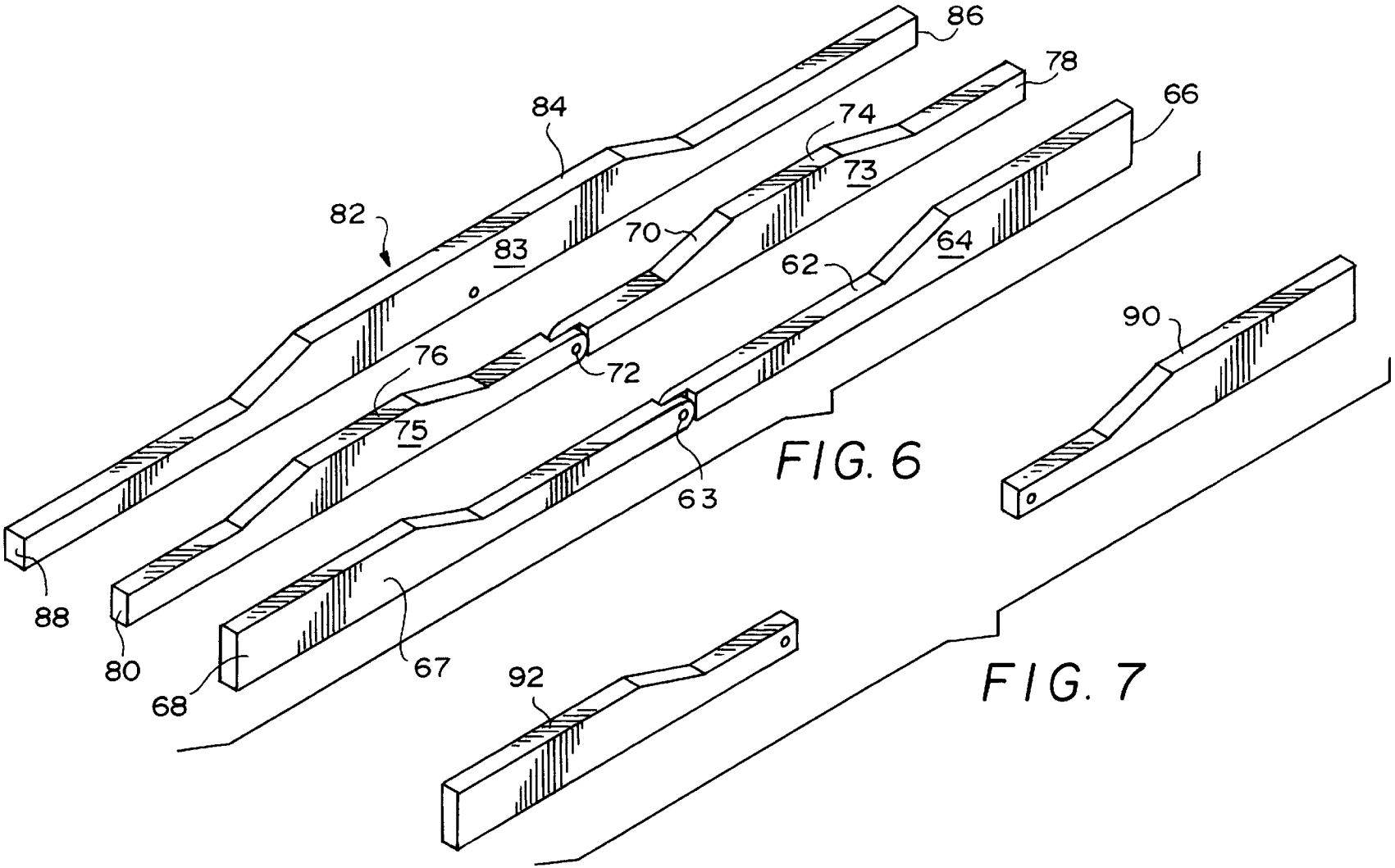
FIG. 6 is an exploded view of the weir shown in FIG. 5.
FIG. 7 shows a variation of the embodiment shown in FIG. 6.

Shown in FIG. 7 are boards 90 and 92 which may be substituted for section 62. Boards 90 and 92 are individually controllable and have raised portions at opposite ends. This arrangement may be preferred on some paper machines.

Figure 12:
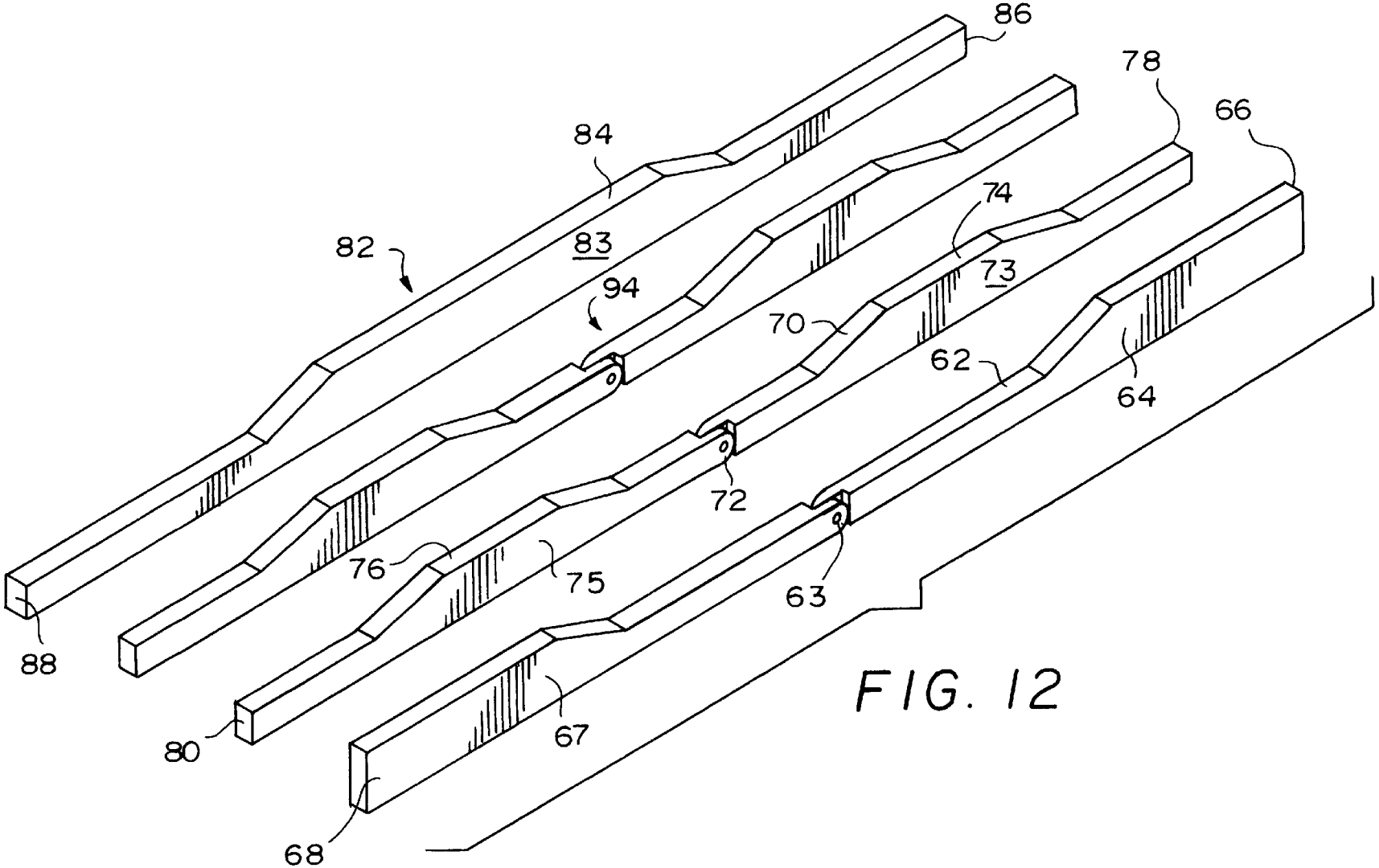
FIG. 12 shows a further variation of the embodiment shown in FIG. 6.

FIG. 12 shows a variation in which a fourth board 94 is provided between the second and third boards.

In actual use, the machine tender will have information from the process controller showing the basis weight profile, the moisture profile and the caliper profile of the sheet as it is being produced, and will use this information, together with information obtained by the back-tender who will physically test samples of paper, to determine if the cross direction profile is uniform. If it is not uniform, the machine tender will use the following procedure to correct the non-uniformity:

If one section is lighter in weight than the center section, that section of the profiling weir will be raised. This will cause that section to increase in basis weight.

If a section is heavier than the center section, that section of the profiling weir will be lowered, and the sheet weight in that section will decrease.

There is an established procedure for the sequence of steps of the adjustment. The edges will be adjusted first to equalize their weight with the center. Then, the intermediate sections will be adjusted.

If the machine has profiling weirs on two vats, they should be adjusted equally.

The machine tender need only learn the approximate amount of adjustment needed to correct a basis weight variation and apply that adjustment. If the adjustment is not quite correct, further adjustments can be made.

EXAMPLES

The following examples relate to the use of a profile control weir according to the invention with a paper machine having seven counterflow vats. The weir of the invention was installed on two of the vats, while conventional two piece wings pivoting in the center were installed on the remaining vats. Cross direction scans were made at the dry end of the paper machine, the initial scan being made within two minutes of the correction, and the final scan being made 7–8 minutes later when the corrections had reached the dry end of the machine.

Example 1

Figure 8A:
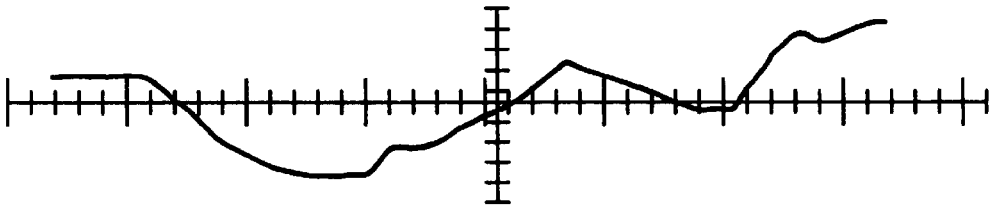
FIGS. 8(*a*)–11(*a*) are graphs of basis weight of papers in the cross-machine direction, before correction.
Figure 8B:
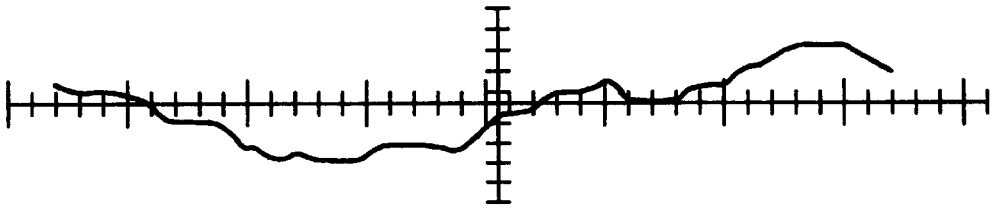

Correction was made on a 90#/MSF paper having an average weight of 89.9#/MSF, a minimum weight of 86.0#/MSF (one side of the center) and a maximum weight of 94.1#/MSF (opposite end of sheet), the difference between maximum and minimum being Δ=8.1#. The profile of this paper is shown in FIG. 8(*a*). Raising the corresponding board by ⅛" improved the profile, with an average weight of 88.2#/MSF, maximum 91.5#/MSF, minimum 85.4#/MSF, Δ=5.7#/MSF, as shown in FIG. 8(*b*).

Example 2

Figure 9A:
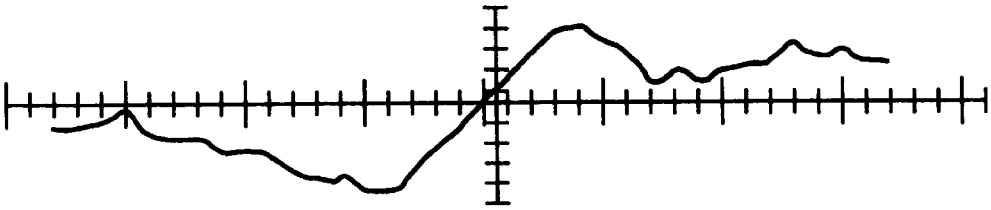
Figure 9B:
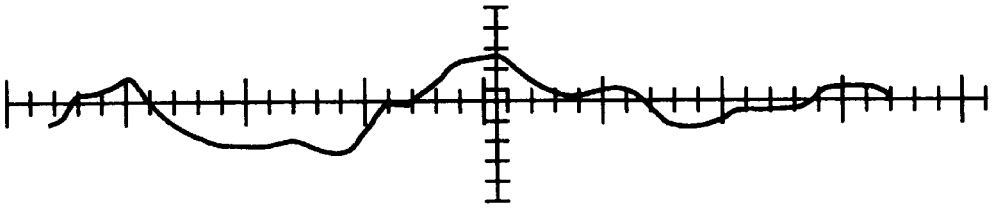

In Example 2, the sheet had two problems, the front side of the sheet having a lower weight than the back side, and the lowest weight being in the front on one side of center. Cross-machine weight variation is shown in FIG. 9(*a*). To make the correction, on one vat, a standard wing board was pivoted ⅛" down to reduce the back side basis weight. On two VATS with the weir of the invention, two boards corresponding to low weights on either side of center were raised by ⅛". The correction, shown in FIG. 9(*b*), was as follows:

| | #/MSF (before correction) | #/MSF (after correction) |
|---|---|---|
| Avg. | 90.2 | 90.1 |
| Max. | 94.3 | 92.8 |
| Min. | 85.9 | 87.8 |
| Δ | 8.4 | 5.0 |

Example 3

Figure 10A:
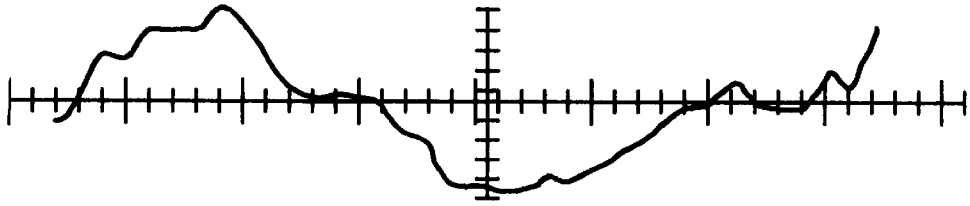
Figure 10B:
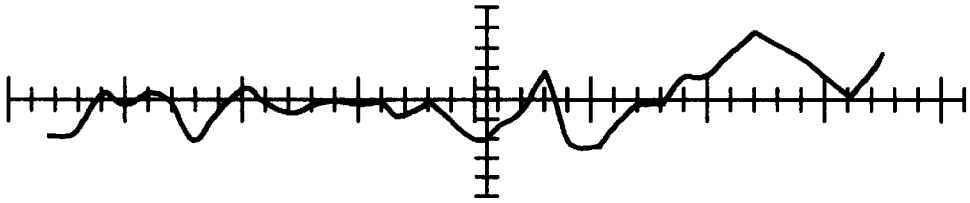

In Example 3, the lowest basis weight was in the center of the sheet, while the highest basis weight was on one side of center, as shown in FIG. 10(*a*). Two boards on the high side were raised by ⅛" with the following results, shown in FIG. 10(*b*):

| | #/MSF (before correction) | #/MSF (after correction) |
|---|---|---|
| Avg. | 106.9 | 106.4 |
| Max. | 111.2 | 109.6 |
| Min. | 103.1 | 104.2 |
| Δ | 8.1 | 5.4 |

Example 4

Figure 11A:
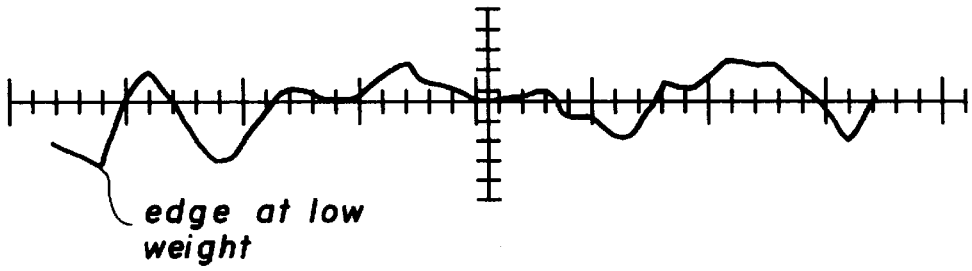
Figure 11B:
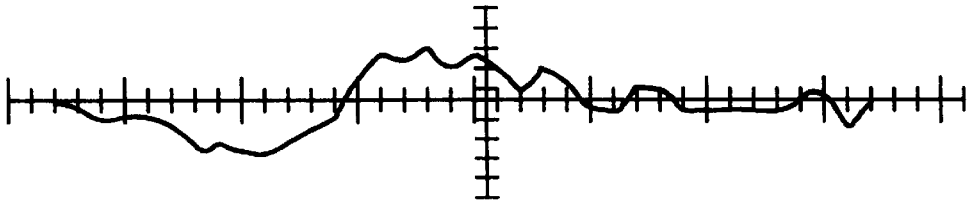

In Example 4, shown in FIG. 11(*a*), the edge had been at a low weight for a period of time, a problem that can create scrap at the slitter-rewinder when slitting narrow widths. One of the edge wings was raised by ⅛" for correction. The edge weight increased, as shown in FIG. 11(*b*), although A remained constant at 5.1.

| | #/MSF (before correction) | #/MSF (after correction) |
|---|---|---|
| Avg. | 106.8 | 105.7 |
| Max. | 108.9 | 108.2 |
| Min. | 103.8 | 103.1 |
| Δ | 5.1 | 5.1 |

What is claimed is:

1. A profile control weir for feeding dilute pulp suspension to a pond having a cylinder rotating therein which deposits pulp fibers onto a felt, the weir comprising:

a head box having an inlet for pulp suspension disposed in a lower portion thereof;

optionally, a making board disposed along an upper front edge of the head box over which pulp suspension flows into the pond;

at least three profile control boards disposed in mutual parallel, adjacent relationship and parallel to the upper front edge of the head box, each said profile control board including an upper edge, each said upper edge comprising at least one raised section having a flat top section, at least one flat lower section, and a connecting side section connecting the at least one raised section and the at least one lower section, the profile control boards including:

a first board comprising two pivoting portions, each of said portions including a raised section at one end thereof and a lower section at an opposite end thereof, the raised sections being outer sections and the lower sections being inner, adjacent sections including pivot means;

a second board comprising two pivotably joined portions, each of said portions having a central raised section and a lower section at ends thereof, inner, lower sections of each of said portions being joined by pivot means; and a unitary third board having a raised center section and lower end sections adjoining said raised center section.

2. The weir of claim 1, additionally comprising a fourth board comprising two pivoting portions, each of said portions comprising a raised section disposed adjacent to a lower inner section, the lower inner sections being joined by a pivot means, each portion further comprising a lower end section disposed outwardly of a raised section.

3. The weir of claim 2, wherein the boards are disposed in a sequence of first board, second board, fourth board and third board in a direction toward the making board.

4. The weir of claim 1, wherein the third board is fixed to the making board.

5. The weir of claim 1, wherein the pivot means of the first and second boards comprises a single central pivot.

6. The weir of claim 1, wherein the pivot means of the first and second boards comprises two pivots, each of said pivots disposed between an end section and a center section of a respective board.

7. The weir of claim 6, wherein the two pivoting portion of the first board are unconnected portions, each having a pivot means.

8. The weir of claim 1, additionally comprising actuators for individually pivoting the first and second boards.

9. The weir of claim 8, wherein the actuators are electric or pneumatic actuators connected by a linkage to the boards.

10. The weir of claim 1, wherein the connecting side section of at least one board is tapered.

* * * * *